US008985576B1

(12) United States Patent
LeFevre et al.

(10) Patent No.: US 8,985,576 B1
(45) Date of Patent: Mar. 24, 2015

(54) SEGMENTED SCUFFER DISK(S) FOR IMPROVED REGISTRATION OF PRINT MEDIA SHEETS

(71) Applicant: XEROX Corporation, Norwalk, CT (US)

(72) Inventors: Jason M. LeFevre, Penfield, NY (US); Douglas K. Herrmann, Webster, NY (US); Derek A. Bryl, Webster, NY (US)

(73) Assignee: XEROX Corporation, Norwalk, CT (US)

( * ) Notice: Subject to any disclaimer, the term of this patent is extended or adjusted under 35 U.S.C. 154(b) by 0 days.

(21) Appl. No.: 14/135,672

(22) Filed: Dec. 20, 2013

(51) Int. Cl.

| | |
|---|---|
| ***B65H 29/22*** | (2006.01) |
| ***B65H 31/34*** | (2006.01) |
| ***B65H 9/00*** | (2006.01) |
| ***B65H 1/04*** | (2006.01) |
| ***B65H 7/20*** | (2006.01) |
| ***B65H 9/10*** | (2006.01) |
| ***B65H 31/36*** | (2006.01) |
| ***B65H 29/40*** | (2006.01) |

(52) U.S. Cl.
CPC ..... *B65H 9/006* (2013.01); *B65H 1/04* (2013.01); *B65H 7/20* (2013.01); *B65H 9/106* (2013.01); *B65H 31/36* (2013.01); *B65H 29/22* (2013.01); *B65H 29/40* (2013.01); *B65H 31/34* (2013.01)
USPC ..... 271/221; 271/314; 271/220; 271/178

(58) Field of Classification Search
CPC ..... B65H 29/22; B65H 29/40; B65H 31/34
USPC ..... 271/221, 220, 314, 223, 224, 178
See application file for complete search history.

(56) References Cited

U.S. PATENT DOCUMENTS

| | | | | |
|---|---|---|---|---|
| 4,017,066 | A * | 4/1977 | Lasher et al. | 271/314 |
| 4,883,265 | A | 11/1989 | Iida et al. | |
| 5,014,977 | A | 5/1991 | Moore et al. | |
| 5,058,880 | A | 10/1991 | McGraw et al. | |
| 5,142,016 | A | 8/1992 | Sharf et al. | |
| 5,931,460 | A * | 8/1999 | Kadowaki et al. | 271/220 |
| 6,032,004 | A | 2/2000 | Mirabella, Jr. et al. | |
| 7,527,260 | B2 | 5/2009 | Moore | |
| 7,784,778 | B2 * | 8/2010 | Shimizu et al. | 270/58.12 |
| 7,793,931 | B2 | 9/2010 | Mizuno | |
| 2004/0070141 | A1 * | 4/2004 | Michels et al. | 271/220 |
| 2008/0230978 | A1 | 9/2008 | Moore et al. | |
| 2008/0246212 | A1 | 10/2008 | Moore | |
| 2008/0296835 | A1 | 12/2008 | Dejong et al. | |
| 2009/0194927 | A1 | 8/2009 | Mandel et al. | |

* cited by examiner

*Primary Examiner* — Luis A Gonzalez
(74) *Attorney, Agent, or Firm* — Gibb & Riley, LLC

(57) ABSTRACT

Disclosed are systems and methods that allow for concurrent leading edge registration and side edge registration of print media sheet(s). Specifically, segmented scuffer disk(s) are mounted to an axle above a tray. The disk(s) can each comprise multiple segments and, as the axle rotates, these segments can engage a print media sheet in the tray (e.g., the top print media sheet on a stack in the tray) and can continuously force that print media sheet in a first direction against a leading edge registration guide. The segments can also be independently flexible in a second direction perpendicular to the first direction. This independent flexibility allows tamper (s) to perform a tamping process in the second direction at the same time as the print media sheet is forced in the first direction, thereby avoiding any slippage of the print media sheet away from the leading edge registration guide.

21 Claims, 8 Drawing Sheets

SEGMENTED SCUFFER DISK(S) FOR IMPROVED REGISTRATION OF PRINT MEDIA SHEETS

BACKGROUND

The systems and methods disclosed herein generally relate to registration of print media sheets in a stack and, more particularly, to concurrent leading edge registration and side edge registration of print media sheets in a stack through the use of rotating segmented scuffer disk(s) and side tamper(s), respectively.

More particularly, printing systems often incorporate a sheet registration system. Specifically, a sheet registration system typically receives a stream of print media sheets. As each print media sheet is received, it is guided onto the top of a stack of print media sheets on a stacking tray (e.g., on an elevator deck) and an articulated scuffer belt engages the leading edge of the top print media sheet in the stack. The articulated scuffer belt rotates, thereby forcing the top print media sheet against a leading edge registration guide. The articulated scuffer belt then lifts up and away from the top print media sheet and side tamper(s) tamp the stack in order to register side edge(s) of the print media sheets in the stack in the cross-process direction. However, when the articulated scuffer belt lifts up, the top print media sheet can slip (i.e., migrate backwards) away from the leading edge registration guide, particularly, if the stacking tray is not level (i.e., if the leading edge of the print media sheets in the stack are higher than the trailing edge).

SUMMARY

In view of the foregoing, disclosed herein are systems that allow for concurrent leading edge registration and side edge registration of print media sheet(s). Specifically, in these systems, one or more segmented scuffer disks are mounted to an axle above a tray. The segmented scuffer disk(s) can each comprise multiple segments and, as the axle rotates, these segments can engage a print media sheet in the tray (e.g., the top print media sheet on a stack in the tray) and can continuously force that print media sheet in a first direction against a leading edge registration guide. The segments of the scuffer disk can also be independently flexible in a second direction perpendicular to the first direction. This independent flexibility allows tamper(s) on the side of the tray to perform a tamping process in the second direction at the same time as the print media sheet is forced in the first direction, thereby avoiding any slippage of the print media sheet away from the leading edge registration guide. Also disclosed herein are associated methods.

More particularly, disclosed herein is a sheet registration system that allows for concurrent leading edge registration and side edge registration of a print media sheet. This system can comprise a tray that receives a print media sheet. The system can further comprise a leading edge registration guide at one end of the tray and an axle above the tray adjacent to the same end. This axle can be parallel to the leading edge registration guide and can rotate continuously.

The system can further comprise one or more segmented scuffer disks mounted to the axle. Each scuffer disk can comprise multiple segments that extend radially from the axle and that are perpendicular to the leading edge registration guide. These segments can engage the print media sheet, as the axle rotates, and, thereby can continuously force that print media sheet in a first direction (i.e., a process direction) towards the leading edge registration guide. That is, the scuffer disk(s) and, particularly, the multiple segments thereof can provide for continuous leading edge registration of the print media sheet. It should be noted, however, that the multiple segments of each scuffer disk can also be independently flexible in a second direction (i.e., a cross-process direction), which is perpendicular to the first direction.

This system can further comprise a tamper positioned laterally adjacent to a side of the tray. While the axle is rotating and the segments of the scuffer disk(s) are engaging the print media sheet, the tamper can concurrently tamp the print media sheet in the second direction. Since the segments of the scuffer disk(s) are independently flexible in the second direction, the print media sheet can move in the second direction during this tamping process without buckling as it is forced by the scuffer disk(s) and, particularly, the multiple segments thereof in the first direction for leading edge registration.

Also disclosed herein is a sheet registration system that allows for concurrent leading edge registration and side edge registration of print media sheets in a stack. This system can comprise a tray that receives a stream of print media sheets such that a stack is formed on the tray. The system can further comprise a leading edge registration guide at one end of the tray and an axle above the tray adjacent to the same end. This axle can be parallel to the leading edge registration guide and can rotate continuously as the stream of print media sheets is received. This axle can further be moveably mounted above the tray, as discussed in greater detail below.

The system can further comprise one or more segmented scuffer disks mounted to the axle. Each scuffer disk can comprise multiple segments that extend radially from the axle and that are perpendicular to the leading edge registration guide. These segments can engage the top print media sheet on the stack, as the axle rotates, and, thereby can continuously force that top print media sheet in a first direction towards the leading edge registration guide. That is, the scuffer disk(s) and, particularly, the multiple segments thereof can provide for continuous leading edge registration of the top print media sheet in the stack. It should be noted, however, that the multiple segments of each scuffer disk can also be independently flexible in a second direction (i.e., a cross-process direction), which is perpendicular to the first direction. Additionally, as mentioned above the axle can be moveably mounted above the tray. Specifically, this axle can be mounted above the tray and can be automatically moveable relative to the stack such that, as the print media sheets are added to the stack and a height of the stack increases, the distance between the stack and the axle remains essentially constant and, thus, the force applied by the disk to the top print media sheet also remains essentially constant.

This system can further comprise a tamper positioned laterally adjacent to a side of the tray. While the axle is rotating above the stack and the segments of the scuffer disk(s) are engaging the top print media sheet, the tamper can concurrently tamp the stack of print media sheets in the second direction. Since the segments of the scuffer disk(s) are independently flexible in the second direction, the top print media sheet can move in the second direction during this tamping without buckling as it is concurrently forced by the scuffer disk(s) and, particularly, the multiple segments thereof in the first direction for leading edge registration.

Also disclosed herein is a sheet registration method that allows for concurrent leading edge registration and side edge registration of a print media sheet. Specifically, this method can comprise receiving, onto a tray, a print media sheet. The method can further comprise using one or more segmented scuffer disk(s) mounted to an axle rotating above the tray to engage the print media sheet and continuously force the print media sheet in a first direction (i.e., in a process direction) towards a leading edge registration guide at one end of the tray. Then, as the print media sheet is engaged by the segmented scuffer disk(s), a tamper positioned laterally adjacent to a side of the tray can be used to tamp the print media sheet in a second direction (i.e., a cross-process direction), which is perpendicular to the first direction. It should be noted that the segmented scuffer disk(s) can each comprise multiple segments and these multiple segments can each be independently flexible in the second direction, thereby allowing for movement of the print media sheet in that second direction during the tamping process without buckling as it is concurrently forced in the first direction for leading edge registration.

Also disclosed herein is a sheet registration method that provides for concurrent leading edge registration and side edge registration of print media sheets in a stack. Specifically, this method can comprise receiving, onto a tray, a stream of print media sheets such that a stack of the print media sheets forms on the tray. The method can further comprise using one or more segmented scuffer disk(s) mounted to an axle rotating above the tray to engage the top print media sheet on the stack and continuously force that top print media sheet in a first direction (i.e., a process direction) towards a leading edge registration guide at one end of the tray. Additionally, as the top print media sheet is engaged by the segmented scuffer disk(s), a tamper positioned laterally adjacent to a side of the tray can be used to tamp the stack in a second direction (i.e., a cross-process direction), which is perpendicular to the first direction. It should be noted that the segmented scuffer disk (s) can comprise multiple segments and these multiple segments can each be independently flexible in the second direction, thereby allowing for movement of the stack of print media sheets in that second direction during the tamping process without buckling as the top print media sheet is concurrently forced in the first direction for leading edge registration. The method can further comprise automatically moving the axle relative to the stack such that, as the print media sheets are added to the stack and a height of the stack increases, a distance between the stack and the axle remains constant and, thus, the force applied by the segmented scuffer disk(s) to the top print media sheet also remains constant.

These and other features are described in, or are apparent from, the following detailed description.

BRIEF DESCRIPTION OF THE DRAWINGS

The disclosed systems and method will be better understood from the following detailed description with reference to the attached figures, which are not necessarily drawn to scale and in which.

DETAILED DESCRIPTION

As mentioned above, printing systems often incorporate a sheet registration system. Specifically, a sheet registration system typically receives a stream of print media sheets. As each print media sheet is received, it is guided onto the top of a stack of print media sheets on a stacking tray (e.g., on an elevator deck) and an articulated scuffer belt engages the leading edge of the top print media sheet in the stack. The articulated scuffer belt rotates, thereby forcing the top print media sheet against the leading edge registration guide. The articulated scuffer belt then lifts up and away from the top print media sheet and side tamper(s) tamp the stack in order to register side edge(s) of the print media sheets in the stack in the cross-process direction. However, when the articulated scuffer belt lifts up, the top print media sheet can slip (i.e., migrate backwards) away from the leading edge registration guide, particularly, if the stacking tray is not level (i.e., if the leading edge of the print media sheets in the stack are higher than the trailing edge).

In view of the foregoing, disclosed herein are systems that allow for concurrent leading edge registration and side edge registration of print media sheet(s). Specifically, in these systems, one or more segmented scuffer disks are mounted to an axle above a tray. The segmented scuffer disk(s) can each comprise multiple segments and, as the axle rotates, these segments can engage a print media sheet in the tray (e.g., the top print media sheet on a stack in the tray) and can continuously force that print media sheet in a first direction (i.e., in a process direction) against a leading edge registration guide. The segments of the scuffer disk can also be independently flexible in a second direction (i.e., a cross-process direction), which is perpendicular to the first direction. This independent flexibility allows tamper(s) on the side of the tray to perform a tamping process in the second direction at the same time as the print media sheet is forced in the first direction, thereby avoiding any slippage of the print media sheet away from the leading edge registration guide. Also disclosed herein are associated methods.

Figure 1:
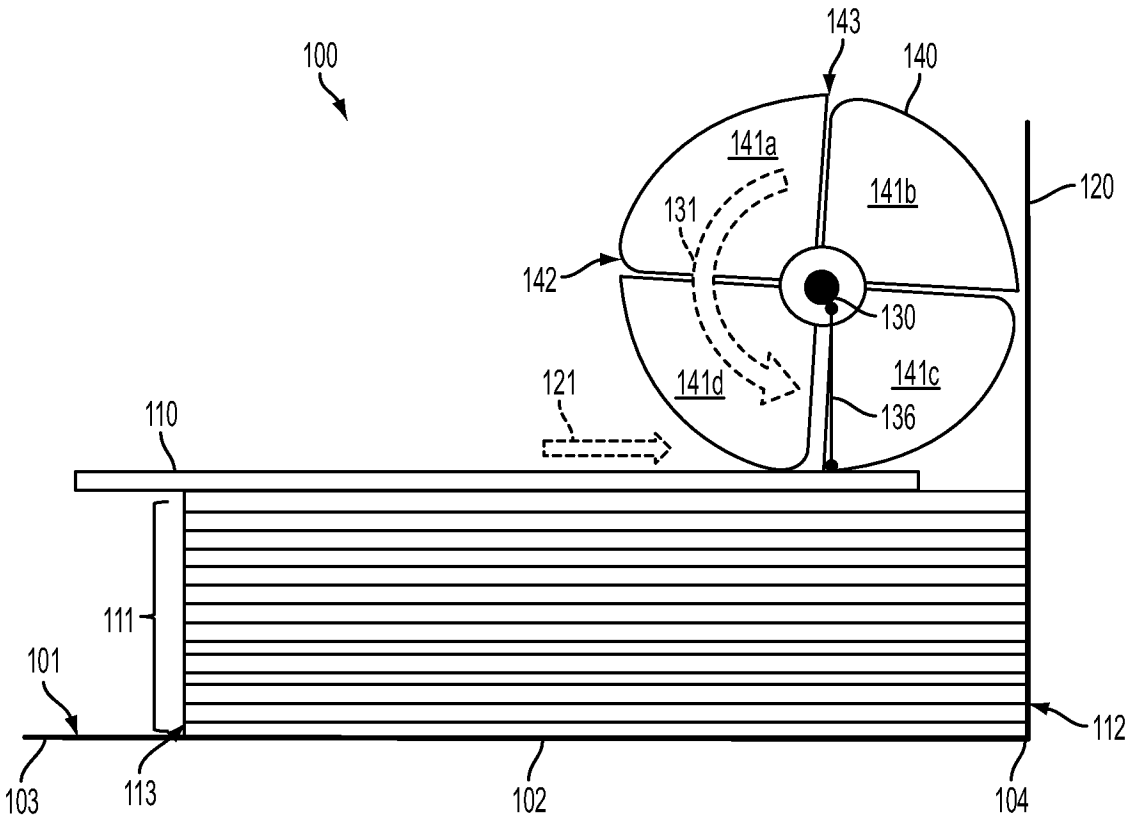
FIG. 1 is a cross-section illustration of a sheet registration system through a plane parallel with the process direction.
Figure 2:
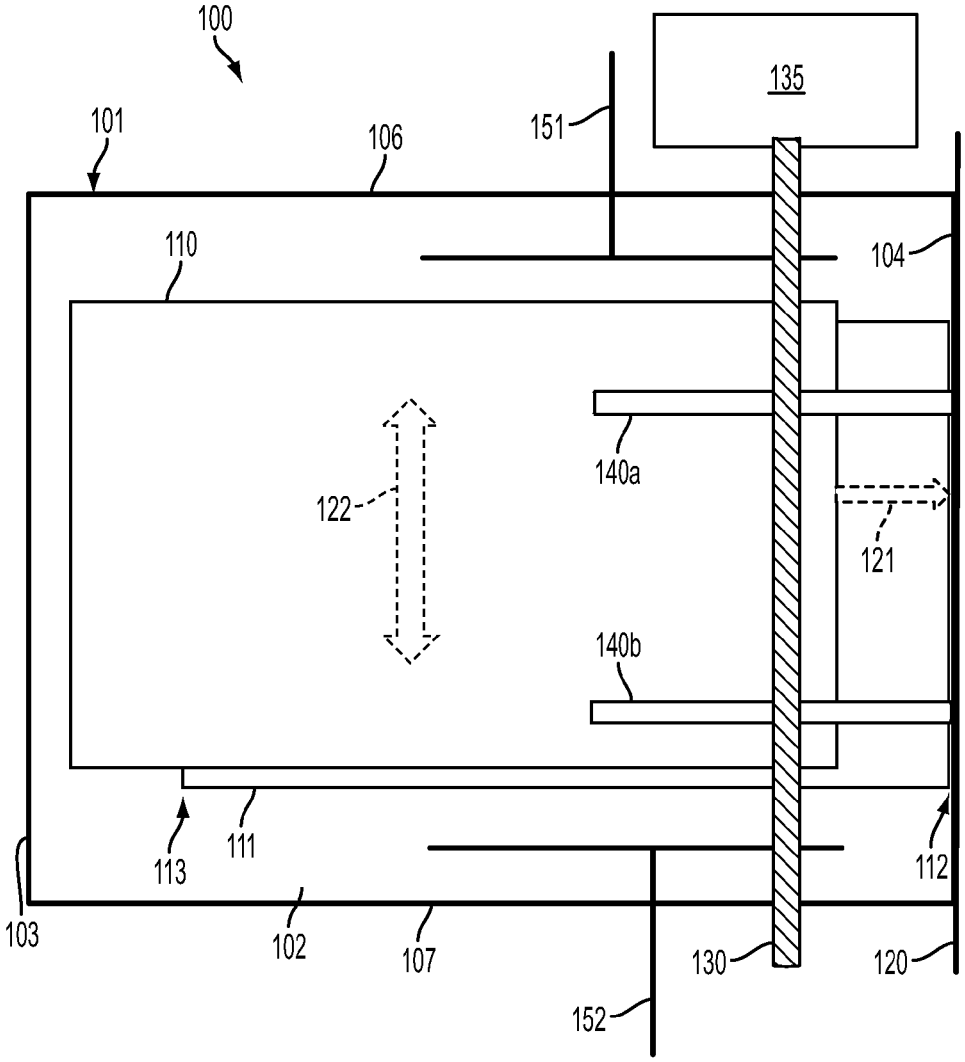
FIG. 2 is a top view illustration of the sheet registration system of FIG. 1.

More particularly, FIGS. 1 and 2 are cross-section and top view illustrations, respectively, of a sheet registration system 100 that allows for concurrent leading edge registration and side edge registration of a print media sheet and, particularly, that allows for concurrent leading edge registration and side edge registration of print media sheets as such sheets are compiled in a stack.

Referring to FIGS. 1 and 2 in combination, this system 100 can comprise a tray 101 (e.g., a sheet stacking tray, such as an elevator deck). The tray 101 can comprise a base 102, a first end 103, a second end 104 opposite the first end 103 and opposing sides (i.e., a first side 106 and a second side 107 opposite the first side 106). The tray 101 can receive a print media sheet 110 and, more particularly, can receive a stream of print media sheets (e.g., from an input at the first end 103 of the tray 101). As the print media sheets are received by the tray 101, they can be guided (e.g., by vacuum transportation, by nips and/or by any other suitable means (not shown)) such that a stack 111 of print media sheets is formed on the base 102 of the tray 101 and such that, as each print media sheet enters the tray 101, it becomes the top print media sheet 110 on the stack 111. The top print media sheet 110 as well as each of the other print media sheets in the stack can have a leading edge 112 and a trailing edge 113 opposite the leading edge 112.

The system 100 can further comprise a leading edge registration guide 120 at the second end 104 of the tray 101. This leading edge registration guide 120 can comprise a fixed, non-flexible, vertical surface, which is essentially parallel to the leading edges 112 of the print media sheets in the stack 111 and which extends upward from the base 102.

The system 100 can further comprise an axle 130 mounted above the tray 101 at the second end 104 such that it is parallel to the leading edge registration guide 120. This system 100 can further comprise a motor 135, which is operably connected to the axle 130 and which causes (i.e., which is adapted to cause, which is configured to cause, etc.) the axle 130 to rotate continuously in a specific rotation direction 131 as the stream of print media sheets is received and formed in the stack 111 on the base 102 of the tray 101. This axle 130 can further be moveably mounted above the tray 101 (e.g., by an elevator mechanism or other suitable mechanism) so that the positioned of the axle 130 relative to the stack 111 can be automatically adjusted, as discussed in greater detail below.

The system 100 can further comprise one or more segmented scuffer disks 140 (e.g., see segmented scuffer disks 140*a* and 140*b* in FIG. 2) mounted to the axle 130. Each segmented scuffer disk 140 can comprise multiple segments 141*a-d* that extend radially from the axle 130 and that are perpendicular to the leading edge registration guide 120.

The segments 141*a-d* of each of the scuffer disk(s) 140 can be essentially wedge-shaped (also referred to herein as petal-shaped) and each wedge-shaped segment can be positioned between and immediately adjacent to two other wedge-shaped segments such that, in combination, they form an essentially circular disk. The segments 141*a-d* can be discrete segments that are attached at the axle 130, thereby forming the essentially circular disk. Alternatively, the segments 141*a-d* can be cut portions of an essentially circular disk. Optionally, the leading side 142 of each segment 141*a-d* (i.e., the first side of the segment 141*a-d* to contact a print media sheet in the specific rotation direction 131 of the axle 130) and, particularly, the corner of that leading side 142 can be rounded (i.e., curved or scalloped in shape) and the trailing side 143 can be angled. For purposes of illustration, FIG. 1 shows a scuffer disk 140 with four segments 141*a-d*. However, it should be understood that, alternatively, any number of three or more segments could be used.

In any case, the segments 141*a-d* of the scuffer disk(s) 140 can engage the top print media sheet 110 on the stack 111, as the axle 130 continuously rotates and, thereby can continuously force that top print media sheet 110 in a first direction 121 and, particularly, in a process direction towards the leading edge registration guide 120. That is, the scuffer disk(s) 140 and, particularly, the multiple segments 141*a-d* thereof can provide for continuous leading edge registration of the top print media sheet 110 in the stack 111, as each new print media sheet to the stack 111 becomes the top print media sheet 110. The scuffer disk(s) 140 can each have a diameter that is at least equal to 1/10 the length of the print media sheets in the stack 111 in order to provide a sufficient force to move the top print media sheet 110 in the first direction 121. Thus, for example, for a paper print media sheet having a length of 10-15 inches, the diameter of the scuffer disk(s) 140 can be 1-5 inches or greater (e.g., 2.3 inches).

For purposes of illustration, FIG. 2 shows two segmented scuffer disks mounted to the axle 130 and, particularly, a first scuffer disk 140*a* mounted adjacent to the first side 106 of the tray 101 and the second scuffer disk 140*b* mounted adjacent to the second side 107 of the tray 101. However, it should be understood that any number of one or more scuffer disks 140 could be incorporated into the disclosed system 100 and the number should be predetermined so that the force applied by the scuffer disk(s) to the top print media sheet 110 is sufficient to move the top print media sheet in the first direction 121 against the leading edge registration guide. Placement of the scuffer disk(s) 140 along the axle 130 should also be predetermined to ensure uniform movement. For example, if a single scuffer disk is used, it should be placed so that it is positioned along the center line of the stack 111; whereas if two scuffer disks are used (e.g., as shown in FIG. 2), they should be positioned symmetrically on opposite sides of the stack 111; and so on.

As mentioned above, the motor 135 causes the axle 130 to rotate continuously in the specific rotation direction 131. The speed at which the motor 135 drives the axle and, thereby drives the scuffer disk(s) can be set to a constant speed and this constant speed can be predetermined to ensure that the tangential speed of the outer surface of the scuffer disk(s) 140 is some small percentage (e.g., 1-3%) higher than the speed of the print media sheet (e.g., from a vacuum or other transport mechanism).

This system 100 can further comprise a tamping mechanism comprising one or more tampers 151-152 positioned laterally adjacent to the opposing sides 106,107 of the tray 101, respectively. While the axle 130 is rotating above the stack 111 and the segments 141*a-d* of the scuffer disk(s) 140 are engaging the top print media sheet 110, the tampers 151-152 can concurrently tamp the stack 111 of print media sheets in the second direction 122 (i.e., in the cross-process direction) for side edge registration. Tamping mechanisms are well known in the art and, thus, the details are omitted from this specification in order to allow the reader to focus on the salient aspects of the disclosed system.

Figure 3:
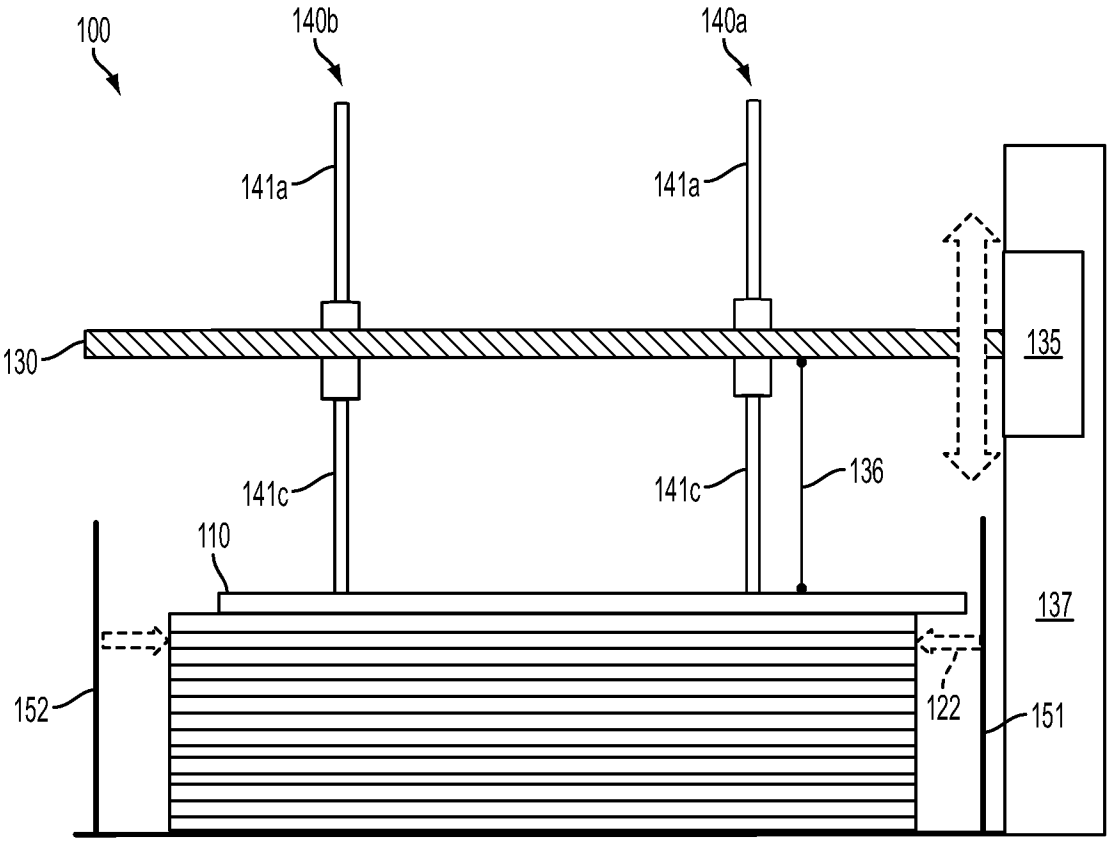
FIG. 3 is a cross-section illustration of the sheet registration system of FIG. 1 through a plane perpendicular to the process direction at one point in time during operation.
Figure 4:
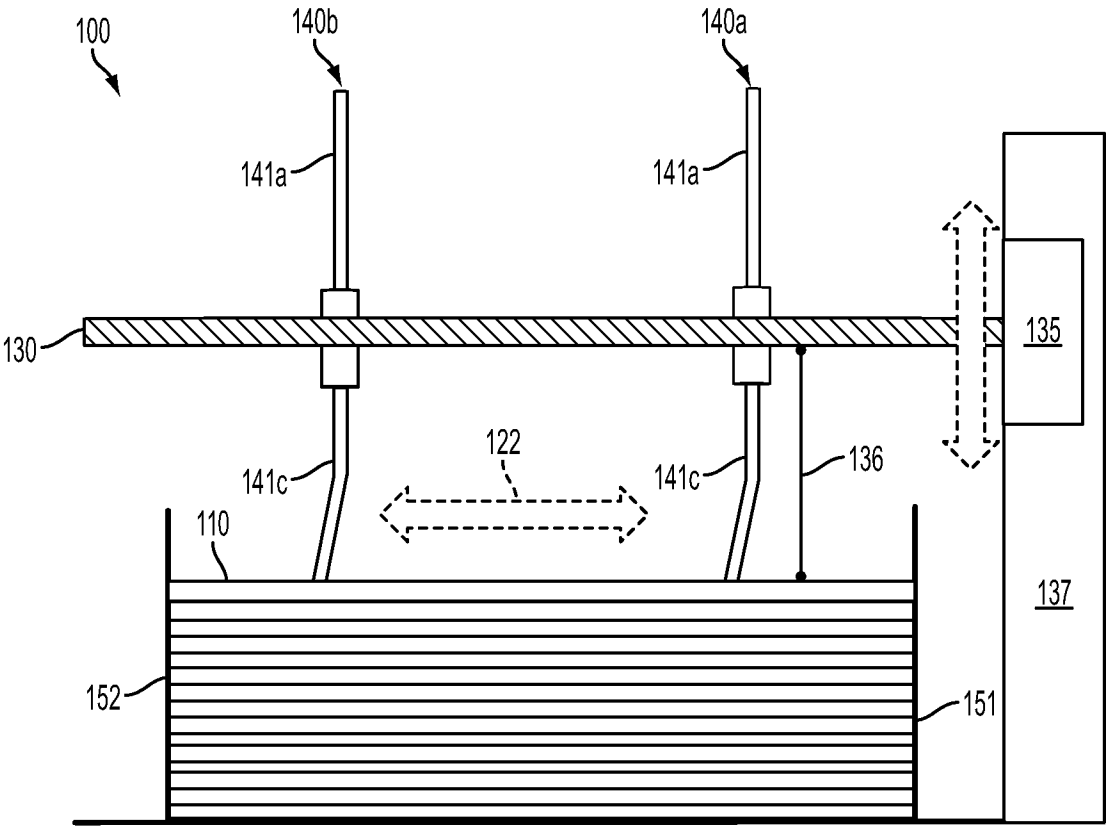
FIG. 4 is a cross-section illustration of the sheet registration system of FIG. 1 through a plane perpendicular to the process direction at another point in time during operation.

In any case, since, as discussed above, the segments 141*a-d* of the scuffer disk(s) 140 are independently flexible in the second direction 122 (i.e., in the cross-process direction), the top print media sheet 110 can move in the second direction 122 for side edge registration during the tamping process without buckling even when that same top print media sheet 110 is simultaneously being forced by the scuffer disk(s) 140 and, particularly, the multiple segments 141*a-d* thereof in the first direction 121 for leading edge registration. More specifically, FIG. 3 is a cross-section of the system 100 through a plane in the second direction 122 (i.e., in the cross-process direction) at a point in time when the segments 141*c* of each of the scuffer disk 140*a* and 140*b* have engaged the top print media sheet 110, but prior to the tampers 151-152 tamping the stack 111. Thus, the top print media sheet 110 is shown as offset from the stack 111 in the second direction 122 and those segments 141*c* of each of the scuffer disks 140*a*-140*b* that are below the axle 130 are essentially perpendicular to and in direct contact with the top print media sheet 110. FIG. 4 is a cross-section of the system 100 through the same plane in the second direction 122 (i.e., in the cross-process direction) at a point in time when the segments 141*c* of each of the scuffer disks 140*a* and 140*b* have engaged the top print media sheet 110 and the tampers 151-152 have tamped the stack 111, causing the top print media sheet 110 to move in the second direction 122. In this case, the top print media sheet 110 is shown as being aligned with the stack 111 and those segments 141*c* that are below the axle 130 are shown as being flexed (i.e., in a flexed or deflected position), but still in direct contact with the top print media sheet 110.

Figure 5:
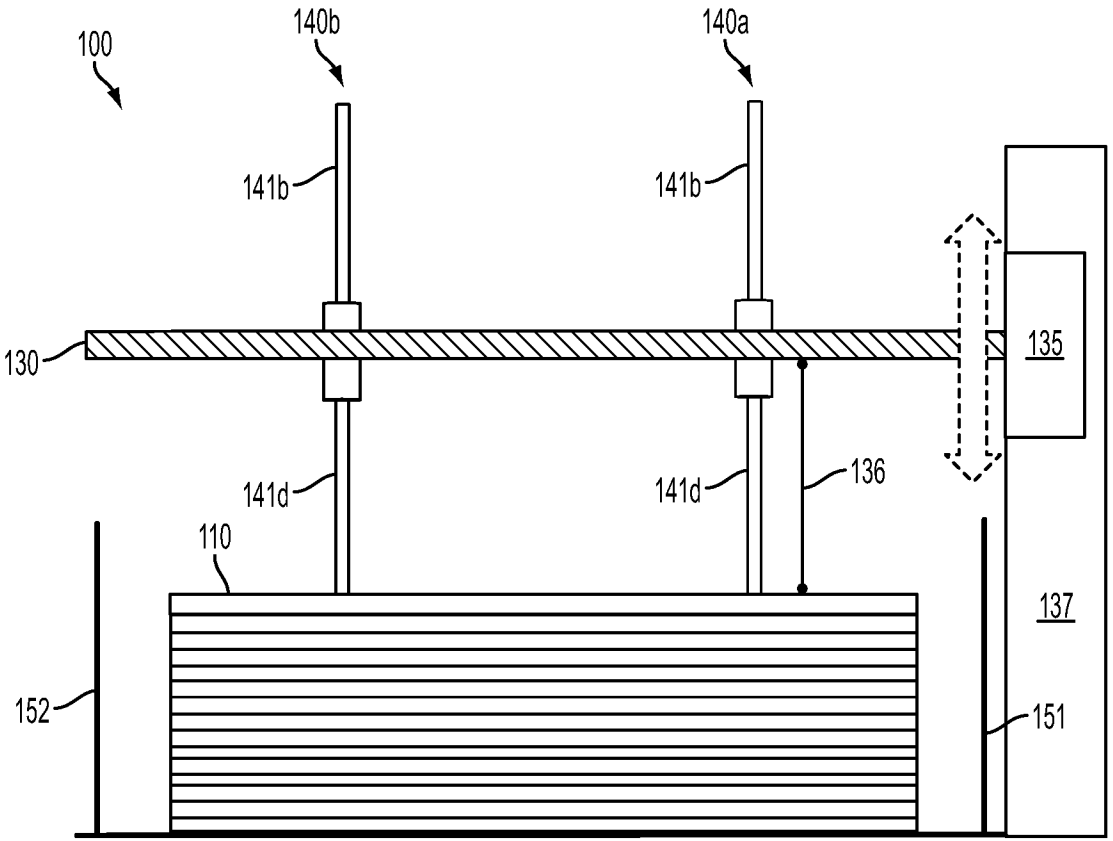
FIG. 5 is a cross-section illustration of the sheet registration system of FIG. 1 through a plane perpendicular to the process direction at yet another point in time during operation.

Those skilled in the art will recognize that each segment that engages the top print media sheet 110 and moves into a flexed position as a function of a tamping process will effectively function as a column (i.e., a beam, pillar, etc.), which is clamped at the upper end attached to the axle 130 and free at the lower end adjacent to the top print media sheet 110, as shown in FIG. 4. Furthermore, since the segments 141*a-d* of each of the scuffer disks 140*a*-140*b* are all independently flexible, as the axle 130 continues to rotate, the segments 141*c* of the scuffer disks 140*a*-140*b* that were in the flexed position following the tamping process, as shown in FIG. 4, will return to an unflexed position (i.e., an undeflected position) as they lift away from the top print media sheet 110 (i.e., they will reset to their natural position) and the next segments 141*d* that engage the top print media sheet 110 will also be in an unflexed position, as shown in FIG. 5, until the tamping is performed.

It should be noted that, as mentioned above, the leading side 142 of each segment 141*a-d* and, particularly, the corner of that leading side 142 can, optionally, be rounded (i.e., curved or scalloped in shape). This rounded shape can ensure a smooth transition during rotation of the axle 130 as one segment and, particularly, a flexed segment lifts away from the top print media sheet 110 and the next segment and, particularly, an unflexed segment engages the top print media sheet 110. This is because the point of impact between the unflexed segment and the print media sheet is rounded as opposed to a small point and also because the distance to the center from that rounded edge at that rounded edge is relatively short as compared to the full column length for the segment.

Referring again to FIGS. 3-5, as mentioned above, the axle 130 can be mounted such that it is positioned above the tray 101 and parallel to the leading edge registration guide 120. More specifically, an elevator mechanism 137 or other suitable lifting mechanism can be operatively connected the axle 130. This elevator mechanism 137 can be configured so as to position the axle 130 above the tray 101 and can further be configured so as to automatically move the axle 130 relative to the stack 111 of print media sheets on the tray 101 such that, as new print media sheets are added to the stack 111 and the height of the stack 111 increases (e.g., as sensed by a sensor in communication with the elevator mechanism 137), the distance 136 between the top print media sheet 110 in the stack 111 and the axle 130 remains essentially constant and equal to slightly less than the radius of the disk (i.e., the length of a single segment 141*a-d*) such that the force applied by the scuffer disk(s) 140*a-b* to the top print media sheet 110 also remains essentially constant. Thus, the scuffer disk(s) 140*a-b* will remain in continuous contact with the top print media sheet 110 or, more particularly, at least one of the segments 141*a-d* of each of the scuffer disks 140*a-b* will always be in contact with the top print media sheet 110 in the stack 111 in order to provide for continuous leading edge registration, even during tamping, without causing the top print media sheet 110 to buckle.

It should be noted that the scuffing properties can be tailored so that the force required to flex any segment 141*a-d* of a scuffer disk 140 will be less than the force required to buckle the thinnest print media sheet that the system 100 would be expected to encounter.

Figure 6:
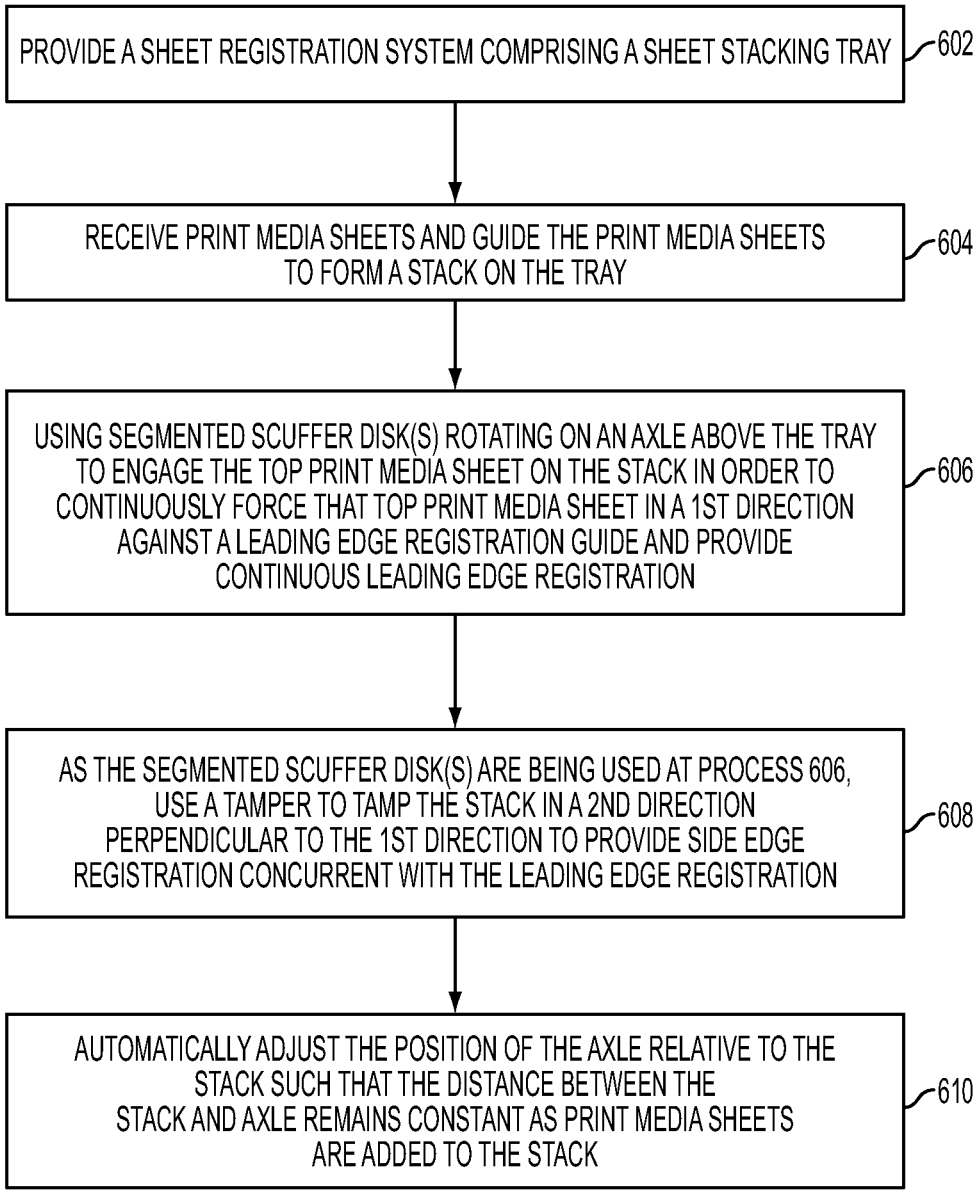
FIG. 6 is a flow diagram illustrating a sheet registration method.

Referring to the flow diagram of FIG. 6 in combination with FIGS. 1-5 described above, also disclosed herein is a sheet registration method that allows for concurrent leading edge registration and side edge registration of a print media sheet and, more particularly, that allows for concurrent leading edge registration and side edge registration of a top print media sheet on a stack of print media sheets. This method can comprise providing a sheet registration system, such as the sheet registration system 100, comprising a tray 101 and, particularly, a sheet stacking tray, such as an elevator deck (602).

Next, a print media sheet 110 and, more particularly, a stream of print media sheets can be received by a tray 101 in the sheet registration system 100 (e.g., from an input at a first end 103 of the tray 101) (604). As the print media sheets are received by the tray 101, they can be guided (e.g., by vacuum transportation, by nips and/or by any other suitable means (not shown)) such that a stack 111 of print media sheets is formed on a base 102 of the tray 101 and such that, as each print media sheet enters the tray 101, it becomes the top print media sheet 110 on the stack 111.

Additionally, as the print media sheets are received by the tray 101 and a stack 111 is formed, one or more segmented scuffer disk(s) 140, which are mounted to a continuously rotating axle 130 above the tray 101 and which have multiple segments 141*a-d*, can be used to engage the top print media sheet 110 on the stack 111 and continuously force that top print media sheet 110 in a first direction 121 and, particularly, in a process direction towards a leading edge registration guide 120 (606).

The method can further comprise, during the process 606 of using the segmented scuffer disk(s) 140, also using tampers 151-152 positioned laterally adjacent to the opposing sides 106, 107 of the tray 101, respectively, to concurrently tamp the stack 111 of print media sheets in the second direction 122 (i.e., in the cross-process direction) for side edge registration (608). In this case, since, as discussed above, the segments 141*a-d* of the scuffer disk(s) 140 are independently flexible in the second direction 122, the top print media sheet 110 can move in the second direction 122 for side edge registration during the tamping process 608 without buckling even when that same top print media sheet 110 is simultaneously being forced at process 606 by the scuffer disk(s) 140 and, particularly, by the multiple segments 141*a-d* thereof in the first direction 121 for leading edge registration. The processes 606 and 608 of using of the segmented scuffer disk(s) 140 and using of the tampers 151-152 can be performed concurrently so that the top print media sheet 110 remains registered against the leading edge registration guide 120 (i.e., so that it does not slip or migrate away from the leading edge registration guide 120) even as tamping is being performed.

Finally, the method can comprise automatically moving the axle 130 relative to the top print media sheet 110 in the stack 111 such that, as new print media sheets are added to the stack 111 and the height of the stack 111 increases, the distance 136 between the top print media sheet 110 on the stack 111 and the axle 130 remains constant and, thus, the force applied by the scuffer disk(s) 140 to the top print media sheet 110 also remains essentially constant (610).

Figure 7:
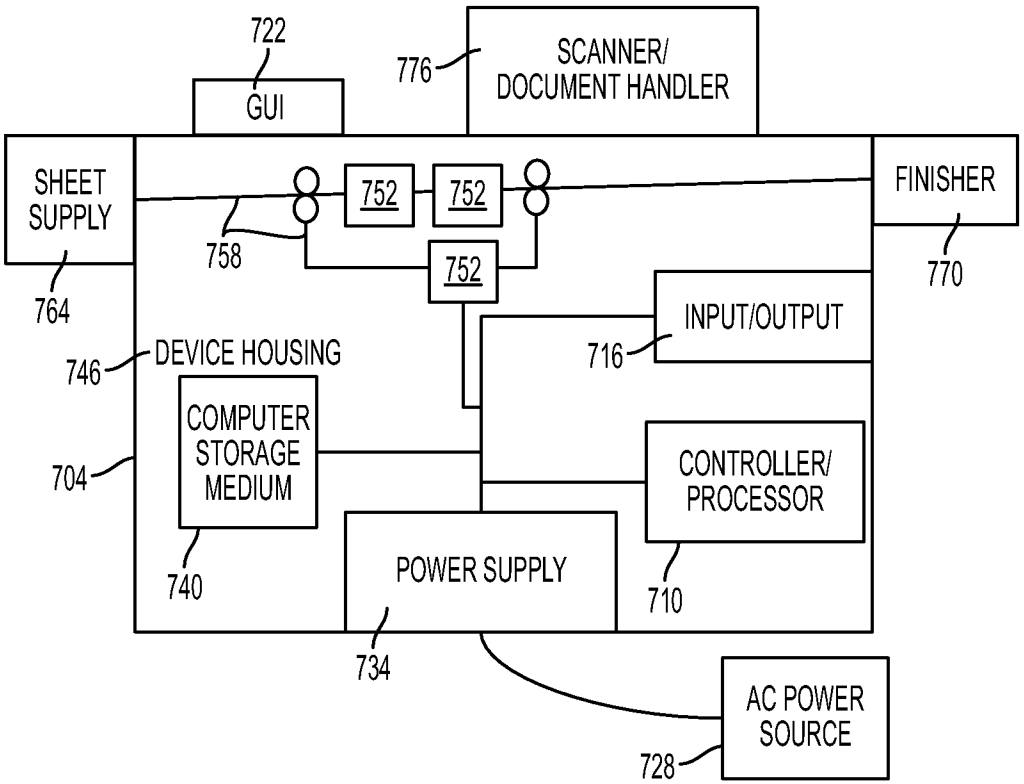
FIG. 7 is a schematic diagram illustrating a multi-function device that can be used in conjunction with the systems and methods disclosed herein.
Figure 8:
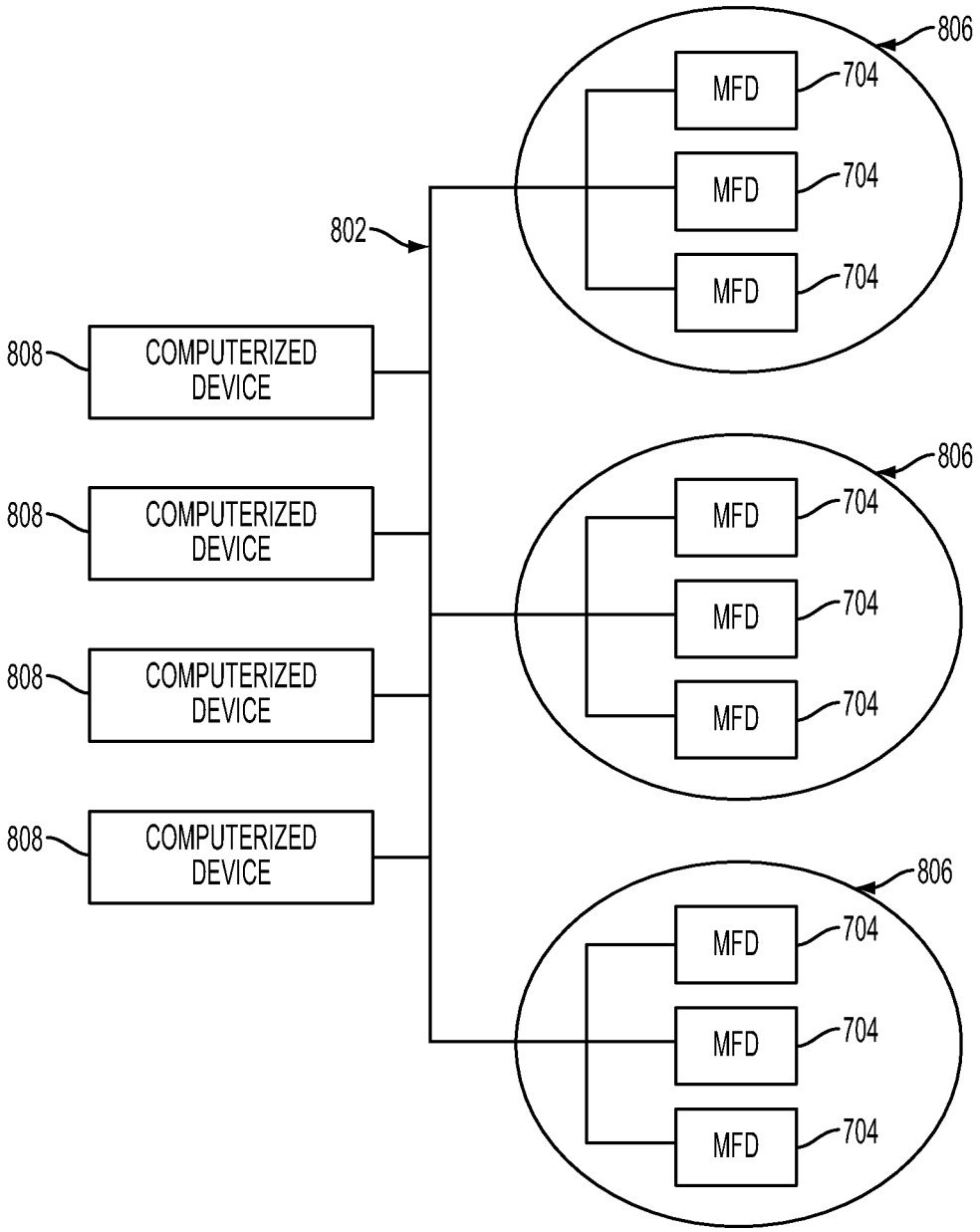
FIG. 8 is a schematic diagram illustrating multiple multi-function devices as shown in FIG. 7 connected via a network.

FIG. 7 illustrates a multi-function device 704 that can be used with the systems and methods disclosed herein and that can comprise, for example, a printer, copier, multi-function machine, etc. The multi-function device 704 includes a controller/processor 710 and a communications port (input/output) 716 operatively connected to the controller/processor 710 and to a network 802 external to the multi-function device 704, as shown in FIG. 8. In addition, the multi-function device 704 can include at least one accessory functional component such as a graphic user interface (GUI) assembly 722 that operates on the power supplied from the AC power source 728, which may be external to the multi-function device 704. The AC power source 728 may provide electrical power through the power supply 734.

The controller/processor 710 controls the various actions of the multi-function device 704. A non-transitory computer storage medium device 740 (which can be optical, magnetic, capacitor based, etc.) is readable by the controller/processor 710 and stores instructions that the controller/processor 710 executes to allow the multi-function device 704 to perform its various functions, such as those described herein. Thus, as shown in FIG. 7, a device housing 746 has one or more functional components that operate on power supplied from the AC power source 728 by the power supply 734. The power supply 734 can comprise a power storage element (e.g., a battery) and connects to the AC power source 728, which may be external to the multi-function device 704. The power supply 734 converts the external power into the type of power needed by the various components.

The multi-function device 704 includes at least one marking device (printing engines) 752 operatively connected to the controller/processor 710, a media path 758 positioned to supply sheets of media from a sheet supply 764 to the marking device(s) 752, etc. After receiving various markings from the printing engine(s), the sheets of media can optionally pass to a finisher 770 which can fold, staple, sort, etc., the various printed sheets. In addition, the multi-function device 704 can include at least one accessory functional component (such as a scanner/document handler 776, etc.) that also operates on the power supplied from the AC power source 728 (through the power supply 734).

As would be understood by those ordinarily skilled in the art, the multi-function device 704 shown in FIG. 7 is only one example and the devices and methods herein are equally applicable to other types of printing devices that may include fewer components or more components. For example, while a limited number of printing engines and paper paths are illustrated in FIG. 7, those ordinarily skilled in the art would understand that many more paper paths and additional printing engines could be included within any printing device used with devices and methods herein.

As shown in FIG. 8, exemplary printers, copiers, multi-function machines, and multi-function devices (MFD) 704 may be located at various different physical locations 806. Other devices according to devices and methods herein may include various computerized devices 808. The computerized devices 808 can include print servers, printing devices, personal computers, etc., and are in communication (operatively connected to one another) by way of a network 802. The network 802 may be any type of network, including a local area network (LAN), a wide area network (WAN), or a global computer network, such as the Internet.

Aspects of the present disclosure are described herein with reference to flowchart illustrations and/or block diagrams of methods, apparatus (systems), and computer program products according to various devices and methods. It will be understood that each block of the flowchart illustrations and/or two-dimensional block diagrams, and combinations of blocks in the flowchart illustrations and/or block diagrams, can be implemented by computer program instructions. The computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

According to a further device and method herein, an article of manufacture is provided that includes a tangible computer readable medium having computer readable instructions embodied therein for performing the steps of the computer implemented methods, including, but not limited to, the method illustrated in FIG. 7. Any combination of one or more computer readable non-transitory medium(s) may be utilized. The computer readable medium may be a computer readable signal medium or a computer readable storage medium. The non-transitory computer storage medium stores instructions, and a processor executes the instructions to perform the methods described herein. A computer readable storage medium may be, for example, but not limited to, an electronic, magnetic, optical, electromagnetic, infrared, or semiconductor system, apparatus, or device, or any suitable combination of the foregoing. Any of these devices may have computer readable instructions for carrying out the steps of the methods described above with reference to FIG. 6.

The computer program instructions may be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

Furthermore, the computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

In case of implementing the devices and methods herein by software and/or firmware, a program constituting the software may be installed into a computer with dedicated hardware, from a storage medium or a network, and the computer is capable of performing various functions if with various programs installed therein.

In the case where the above-described series of processing is implemented with software, the program that constitutes the software may be installed from a network such as the Internet or a storage medium such as the removable medium. Examples of a removable medium include a magnetic disk (including a floppy disk), an optical disk (including a Compact Disk-Read Only Memory (CD-ROM) and a Digital Versatile Disk (DVD)), a magneto-optical disk (including a Mini-Disk (MD) (registered trademark)), and a semiconductor memory. Alternatively, the storage medium may be the ROM, a hard disk contained in the storage section of the disk units, or the like, which has the program stored therein and is distributed to the user together with the device that contains them.

As will be appreciated by one skilled in the art, aspects of the devices and methods herein may be embodied as a system, method, or computer program product. Accordingly, aspects of the present disclosure may take the form of an entirely hardware system, an entirely software system (including firmware, resident software, micro-code, etc.) or an system combining software and hardware aspects that may all generally be referred to herein as a "circuit," "module", or "system." Furthermore, aspects of the present disclosure may take the form of a computer program product embodied in one or more computer readable medium(s) having computer readable program code embodied thereon.

Any combination of one or more computer readable non-transitory medium(s) may be utilized. The computer readable medium may be a computer readable signal medium or a computer readable storage medium. The non-transitory computer storage medium stores instructions, and a processor executes the instructions to perform the methods described herein. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium include the following: an electrical connection having one or more wires, a portable computer diskette, a hard disk, a random access memory (RAM), a Read Only Memory (ROM), an Erasable Programmable Read Only Memory (EPROM or Flash memory), an optical fiber, a magnetic storage device, a portable compact disc Read Only Memory (CD-ROM), an optical storage device, a "plug-and-play" memory device, like a USB flash drive, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including, but not limited to, wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Smalltalk, C++, or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The flowchart and block diagrams in the figures illustrate the architecture, functionality, and operation of possible implementations of systems, methods, and computer program products according to various devices and methods herein. In this regard, each block in the flowchart or block diagrams may represent a module, segment, or portion of code, which comprises one or more executable instructions for implementing the specified logical function(s). It should also be noted that, in some alternative implementations, the functions noted in the block might occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well known by those ordinarily skilled in the art and are discussed in, for example, U.S. Pat. No. 6,032,004, the complete disclosure of which is fully incorporated herein by reference. Such details are not described in detail herein to keep this disclosure focused on the salient features presented. The devices and methods herein can encompass devices that print in color, monochrome, or handle color or monochrome image data. All foregoing devices and methods are specifically applicable to electrostatographic and/or xerographic machines and/or processes.

The terminology used herein is for the purpose of describing particular devices and methods only and is not intended to be limiting of this disclosure. As used herein, the singular forms "a", "an", and "the" are intended to include the plural forms as well, unless the context clearly indicates otherwise. It will be further understood that the terms "comprises", "comprising," "including" and/or "includes", when used in this specification, specify the presence of stated features, integers, steps, operations, elements, and/or components, but do not preclude the presence or addition of one or more other features, integers, steps, operations, elements, components, and/or groups thereof.

In addition, terms such as "right", "left", "vertical", "horizontal", "top", "bottom", "upper", "lower", "under", "below", "underlying", "over", "overlying", "parallel", "perpendicular", etc., used herein, are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms 'automated' or 'automatically' mean that once a process is started (by a machine or a user); one or more machines perform the process without further input from any user.

The corresponding structures, materials, acts, and equivalents of all means or step plus function elements in the claims below are intended to include any structure, material, or act for performing the function in combination with other claimed elements as specifically claimed. The descriptions of the various devices and methods of the present disclosure have been presented for purposes of illustration, but are not intended to be exhaustive or limited to the devices and methods disclosed. Many modifications and variations will be apparent to those of ordinary skill in the art without departing from the scope and spirit of the described devices and methods. The terminology used herein was chosen to best explain the principles of the devices and methods, the practical application or technical improvement over technologies found in the marketplace, or to enable others of ordinary skill in the art to understand the devices and methods disclosed herein.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the devices and methods herein cannot be implied or imported from any above example as limitations to any particular order, number, position, size, shape, angle, color, or material.

Therefore, disclosed above are systems that allow for concurrent leading edge registration and side edge registration of print media sheet(s). Specifically, in these systems, one or more segmented scuffer disks are mounted to an axle above a tray. The segmented scuffer disk(s) can each comprise multiple segments and, as the axle rotates, these segments can engage a print media sheet in the tray (e.g., the top print media sheet on a stack in the tray) and can continuously force that print media sheet in a first direction (i.e., in a process direction) against a leading edge registration guide. The segments of the scuffer disk can also be independently flexible in a second direction (i.e., in a cross-process direction) perpendicular to the first direction. This independent flexibility allows tamper(s) on the side of the tray to perform a tamping process in the second direction at the same time as the print media sheet is forced in the first direction, thereby avoiding any slippage of the print media sheet away from the leading edge registration guide. Also disclosed herein are associated methods.

What is claimed is:

1. A sheet registration system comprising:

a tray receiving a print media sheet;

a leading edge registration guide at one end of said tray;

an axle rotating above said tray adjacent to said end and parallel to said leading edge registration guide;

at least one segmented scuffer disk mounted to said axle, each scuffer disk comprising multiple segments extending radially from said axle and perpendicular to said leading edge registration guide, and said multiple segments engaging said print media sheet, as said axle rotates, so as to continuously force said print media sheet in a first direction towards said leading edge registration guide; and, a tamper positioned laterally adjacent to a side of said tray, said tamper tamping said print media sheet in a second direction perpendicular to said first direction, said multiple segments each being independently flexible in said second direction so as to allow for movement of said print media sheet in said second direction during said tamping as said print media sheet is concurrently forced in said first direction.

2. The sheet registration system of claim 1, said at least one segmented scuffer disk being in continuous contact with said print media sheet during said tamping.

3. The sheet registration system of claim 1, said multiple segments each being independently flexible such that, as said axle rotates, any segment in a flexed position following said tamping will return to an unflexed position as said segment lifts away from said print media sheet.

4. The sheet registration system of claim 1, said multiple segments comprising at least three wedge-shaped segments.

5. The sheet registration system of claim 4, said wedge-shaped segments each having a rounded corner that initially contacts said print media sheet as said axle rotates.

6. The sheet registration system of claim 1, said at least one segmented scuffer disk comprising at least a first scuffer disk and a second suffer disk adjacent to opposite sides of said tray.

7. The sheet registration system of claim 1, said at least one segmented scuffer disk having a diameter that is at least equal to 1/10 of a length of said print media sheet.

8. A sheet registration system comprising:

a tray receiving a stream of print media sheets such that a stack forms on said tray;

a leading edge registration guide at one end of said tray;

an axle above said tray adjacent to said end and parallel to said leading edge registration guide, said axle rotating during said receiving of said stream;

at least one segmented scuffer disk mounted to said axle, each scuffer disk comprising multiple segments extending radially from said axle and perpendicular to said leading edge registration guide, and said multiple segments engaging a top print media sheet on said stack, as said axle rotates, so as to continuously force said top print media sheet in a first direction towards said leading edge registration guide, and said axle being automatically moveable above said tray such that, as said print media sheets are added to said stack and a height of said stack increases, a distance between said stack and said axle remains constant; and, a tamper positioned laterally adjacent to a side of said tray, said tamper tamping said stack in a second direction perpendicular to said first direction, said multiple segments each being independently flexible in said second direction so as to allow for movement of said top print media sheet in said second direction during said tamping as said top print media sheet is concurrently forced in said first direction.

9. The sheet registration system of claim 8, said distance being predetermined such that said at least one segmented scuffer disk remains in continuous contact with said top print media sheet during said tamping without causing said top print media sheet to buckle.

10. The sheet registration system of claim 8, said multiple segments each being independently flexible such that, as said axle rotates, any segment in a flexed position following said tamping will return to an unflexed position as said segment lifts away from said top print media sheet.

11. The sheet registration system of claim 8, said multiple segments comprising at least three wedge-shaped segments.

12. The sheet registration system of claim 11, said wedge-shaped segments each having a rounded corner that initially contacts said top print media sheet as said axle rotates.

13. The sheet registration system of claim 8, said at least one segmented scuffer disk comprising at least a first scuffer disk and a second suffer disk adjacent to opposite sides of said tray.

14. The sheet registration system of claim 8, said at least one segmented scuffer disk having a diameter that is at least equal to 1/10 of a length of said print media sheet.

15. A sheet registration method comprising:

receiving, onto a tray, a print media sheet;

using at least one segmented scuffer disk mounted to an axle rotating above said tray to engage said print media sheet and continuously force said print media sheet in a first direction towards a leading edge registration guide at one end of said tray; and, during said using of said at least one segmented scuffer disk, using a tamper positioned laterally adjacent to a side of said tray to tamp said print media sheet in a second direction perpendicular to said first direction, said at least one segmented scuffer disk comprising multiple segments and aid multiple segments each being independently flexible in said second direction so as to allow for movement of said print media sheet in said second direction during tamping as said print media sheet is concurrently forced in said first direction.

16. The method of claim 15, said using of said at least one segmented scuffer disk and said using of said tamper being performed concurrently so that said print media sheet remains registered against said leading edge registration guide.

17. The method of claim 15, said at least one segmented scuffer disk comprising multiple segments each being independently flexible such that, as said axle rotates, any segment in a flexed position following said tamping will return to an unflexed position as said segment lifts away from said print media sheet.

18. The method of claim 17, said multiple segments comprising at least three wedge-shaped segments.

19. The method of claim 18, said wedge-shaped segments each having a rounded corner that initially contacts said print media sheet during said rotation of said axle.

20. The method of claim 15, said at least one segmented scuffer disk comprising at least a first scuffer disk adjacent to a first side of said tray and a second suffer disk adjacent to a second side of said tray.

21. A sheet compiling and registration method comprising:

receiving, onto a tray, a stream of print media sheets such that a stack forms on said tray;

using at least one segmented scuffer disk mounted to an axle rotating above said tray to engage a top print media sheet on said stack and continuously force said top print media sheet in a first direction towards a leading edge registration guide at one end of said tray;

during said using of said at least one segmented scuffer disk, using a tamper positioned laterally adjacent to a side of said tray to tamp said stack in a second direction perpendicular to said first direction, said at least one segmented scuffer disk comprising multiple segments and said multiple segments each being independently flexible in said second direction so as to allow for movement of said top print media sheet in said second direction during tamping as said top print media sheet is concurrently forced in said first direction; and, automatically moving said axle relative to said stack such that, as said print media sheets are added to said stack and a height of said stack increases, a distance between said stack and said axle remains constant.

* * * * *